United States Patent [19]

Stevenson

[11] 4,058,251

[45] * Nov. 15, 1977

[54] FOLDED MONEY PACK ENVELOPE

[75] Inventor: Mayne B. Stevenson, Park Ridge, Ill.

[73] Assignee: Arvey Corporation, Chicago, Ill.

[ * ] Notice: The portion of the term of this patent subsequent to July 27, 1993, has been disclaimed.

[21] Appl. No.: 742,082

[22] Filed: Nov. 16, 1976

[51] Int. Cl.[2] ..... B65D 27/08

[52] U.S. Cl. ..... 229/72; 229/75; 229/80; 229/87 R

[58] Field of Search ..... 229/72, 68 R, 76, 80, 229/75, 87 R, 92.7; 206/39.7; 150/38, 39

[56] References Cited

U.S. PATENT DOCUMENTS

| | | | |
|---|---|---|---|
| 1,662,843 | 3/1928 | Backmyer | 229/72 |
| 3,043,493 | 7/1962 | Clegg | 229/72 |
| 3,528,602 | 9/1970 | Ritchie | 229/72 X |
| 3,531,046 | 9/1970 | Carrigan | 229/72 |
| 3,642,195 | 2/1972 | Tulisalo | 229/72 |
| 3,858,791 | 1/1975 | Gendron | 229/72 |
| 3,888,408 | 6/1975 | Clipner | 229/76 |
| 3,889,873 | 6/1975 | Clough | 229/72 |
| 3,971,507 | 7/1976 | Stevenson | 229/72 |

*Primary Examiner*—Stephen P. Garbe
*Attorney, Agent, or Firm*—Dressler, Goldsmith, Clement, Gordon & Shore, Ltd.

[57] ABSTRACT

A money pack envelope which is formed from a single piece of folded paper is disclosed herein. The sheet of flat paper has a pair of spaced parallel fold lines that divide the sheet into a central panel portion and first and second panel portions on respective sides of the central panel portion. The first and second panel portions are folded so that the first panel portion is located between the second panel portion and the central panel portion. The first panel portion also has an inwardly offset portion at one end of the envelope to expose a portion of the central panel portion and the central panel portion has a tab folded along a fold line so that the tab can be connected to the second panel portion.

4 Claims, 4 Drawing Figures

FOLDED MONEY PACK ENVELOPE

BACKGROUND OF THE INVENTION

The present invention relates generally to envelopes of the type disclosed in U.S. Pat. No. 3,971,507 and more particularly to an envelope of the type shown in this patent which is particularly designed for use with automatic currency insertion equipment.

As explained in the above patent, the use of an envelope type carrier for transporting money has been in existence for years and recently the banking industry has developed computerized automatic banking centers that may be positioned at remote locations and need not have an operator or a teller present for the customer to transact business.

The particular envelope disclosed in the above patent has found a remarkable degree of commercial success for use in computerized banking centers as well as drive-in teller windows. However, it has been found that such envelopes cannot be filled with currency utilizing existing automatic insertion equipment.

SUMMARY OF THE INVENTION

According to the present invention, a very simple money pack envelope carrier has been developed which can pass through automatic machines at remotely located banking centers and also can be filled automatically with insertion machines.

More specifically, a single sheet of flat paper has a plurality of fold lines and has a peripheral configuration that allows the sheet to be folded to produce a generally rectangular envelope.

The sheet has two parallel fold lines that divide it into a central panel portion and first and second panel portions extending from opposite edges of the central panel portion. The central panel portion also has a further fold line extending perpendicular to the first and second fold lines to produce a tab on one end of the central panel. The tab is adapted to be folded inwardly in overlapping relation to the central panel and the first panel portion has a flat edge that is inwardly offset from the further fold line so that the free edge of the tab and the edge of the first panel are spaced from each other by a small dimension and extend parallel to each other. The tab also has a further lateral edge that is spaced from the first fold line between the central panel portion and the first panel portion so that a portion of the central panel portion is exposed when the envelope is in a fully folded and assembled condition.

The particular location of the tab with respect to the panel portions allows the second panel portion to be separated from the adjacent overlapping first panel portion, when the envelope is in assembled condition so that automatic machinery can be utilized for inserting currency between these two panel portions.

DETAILED DESCRIPTION

Figure 1:
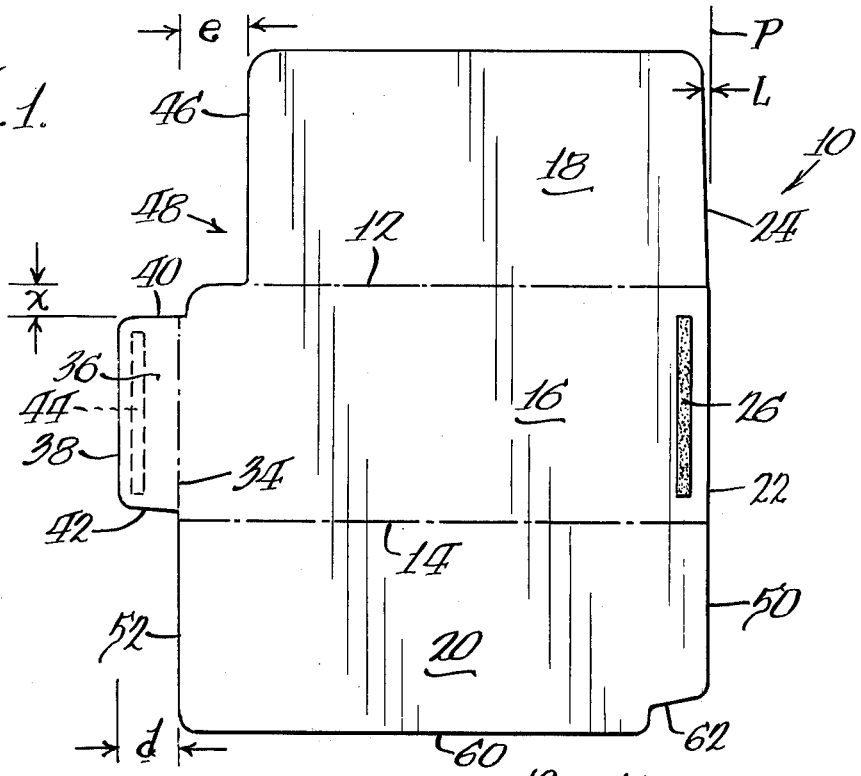
FIG. 1 is a plan view of a sheet in its flat configuration prior to the formation of an envelope.

While this invention is susceptible of embodiment in many different forms, there is shown in the drawing and will herein be described in detail preferred embodiments of the invention, with the understanding that the present disclosure is to be considered as an exemplification of the principles of the invention and is not intended to limit the invention to the embodiments illustrated. The scope of the invention will be pointed out in the appended claims.

Figure 3:
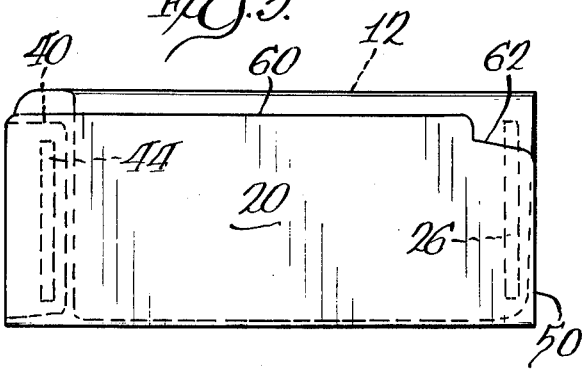
FIG. 3 shows the envelope in its fully closed condition, with sections thereof broken away for purposes of clarity.

FIG. 1 of the drawings generally discloses a flat sheet that has been transformed to produce the envelope shown in FIG. 3. Flat sheet 10 is generally rectangular in plan view and has first and second fold lines 12 and 14 which divide the sheet into a flat central panel portion 16, a first panel portion 18 located on the side of the central panel portion and a second panel portion 20 located on the opposite side of the central panel portion.

Central panel portion 16 has a flat planar edge 22 while first panel portion 18 also has a flat lateral edge 24 that defines an extension of flat planar edge 22 and flat lateral edge 24 is angularly related to flat lateral edge 22 when the sheet is in its unfolded condition as illustrated in FIG. 1. Stated another way, lateral edge 24 of first panel portion 18 defines a small included angle L with respect to a plane P and this included angle L is at least 1° and desirably is less than 5°, for a purpose that will be described later. Also, the central panel portion has an elongated line of adhesive or connecting means 26 adjacent edge 22.

Thus, when sheet 10 is folded along first fold line 12, a first surface of sheet 10 will have its first surface portions of central panel portion 16 and first panel portion 18 in contiguous contacting engagement with each other and the two panel portions can be interconnected utilizing single elongated line of adhesive 26.

Figure 2:
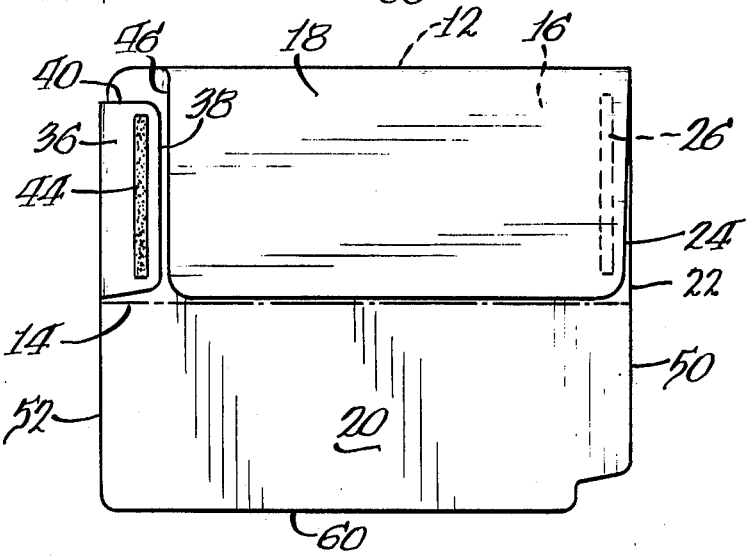
FIG. 2 shows the envelope in a partially folded condition.

As viewed in FIG. 2, it will be noted that the central panel portion 16 and first panel portion 18 define a double thickness and these panel portions are closed along two perpendicular edges and are open along the other two edges. It will also be noted that in the first or partially folded condition shown in FIG. 2, lateral edge 24 of first panel portion 18 is located inwardly of lateral edge 22 of central panel portion 16. This insures that this lateral edge will not extend beyond the periphery of the finished envelope and create a problem in a transfer of the envelope in automatic machines.

According to the present invention, central panel portion 16 and second panel portion 20 are interconnected in a unique manner so that the contents of the envelope, such as currency, can be inserted by automatic machinery, such as a Bell & Howell Philipsburg inserting machine.

As shown in FIGS. 1 and 2, central panel portion 16 has a further fold line 34 that extends generally parallel to lateral edge 22 on the opposite end thereof and defines a tab 36. Tab 36 has an outer free edge 38 that extends parallel to further fold line 34 and has further edges 40 and 42 so that the tab 36 defines a generally rectangular extension beyond one end of central panel portion 16. As most clearly shown in FIG. 1, edge 40 extends generally parallel to fold line 12 and is spaced therefrom by a dimension *x*. This spacing is of significance, as will be explained later.

Tab 36 again has a second area or line of adhesive 44 which extends generally parallel to the outer lateral edge and is exposed when tab 36 is folded along fold line 34 as illustrated in FIG. 2.

First panel portion 18 has a second flat lateral edge 46 that is laterally offset inwardly of fold line 34 and extends generally parallel thereto to define a recess 48.

The remainder of the sheet includes a second panel portion 20 which again has a first lateral edge 50 that extends parallel to and defines an extension of lateral edge 22 on one end of the sheet and a second lateral edge 52 which defines an extension of further fold line 34 on the opposite end of second panel portion 20.

As most clearly shown in FIG. 1, the spacing between fold line 34 and outer free edge 38 of tab 36 has a dimension d while the spacing or offset of lateral edge 46 with respect to fold line 34 has a dimension e. The dimension d is less than the dimension e so that when tab 36 is folded from the position illustrated in FIG. 1 to that illustrated in FIG. 2, lateral free edge 38 extends parallel to edge 46 but is spaced therefrom. Also, in this position, the strip of adhesive 44 is exposed as clearly illustrated in FIG. 2. It should also be noted that in the folded position for tab or flap 36, the edge 40 which will be termed the upper edge of the tab is spaced from the upper edge of the envelope, defined by fold line 12. Thus, when the sheet is folded along fold line 14, second panel portion 20 will be adhesively secured to tab 36.

The significance of having the tab integral with the central portion will now be described. As will be appreciated, when automatic machinery is utilized, "suckers" are used to partially separate second panel portion 20 from first panel portion 18 so that the contents, such as currency, can be inserted between these two panel portions. Having the tab 36 integral with central panel portion 16 will allow the tab to be partially separated from central panel portion 16 when second panel portion 20 is separated from first panel portion 18 to provide clear access for the insertion of currency. Also, the particular location of the upper edge 40, being spaced from fold line 12 and generally aligned with free edge 60 of second panel portion 20, will ensure that the currency will not tend to snag on this lateral edge during the automatic insertion into the envelope.

As shown in FIG. 3, the free edge 60 of second panel portion 20 extends generally parallel to fold line 14 but is spaced therefrom so that the edge 60 is located below the upper edge or outer edge of the envelope when the sheet is folded along fold line 14 and second panel portion 20 is connected to the tab. As illustrated in FIG. 3, the second panel portion 20 also has a cutout 62 between lateral edges 50 and 60 so as to expose a further portion of first panel portion 18 as a gripping area for grasping the central panel portion and first panel portion and separating the second panel portion therefrom.

Figure 4:
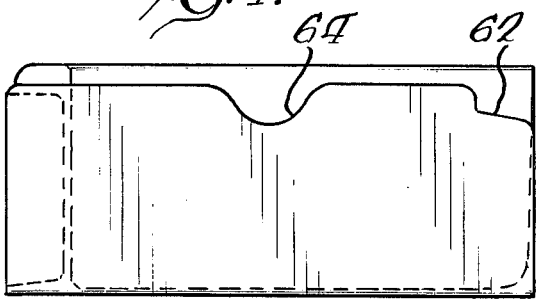
FIG. 4 is a view similar to FIG. 3 showing a slightly modified envelope.

If desired, the second panel portion may also have a further recess 64 located intermediate opposite ends thereof, as shown in FIG. 4. Thus, the central panel portion may be gripped by inserting a finger or thumb into the recessed area 64 and partially folding back central panel portion and first panel portion so that the contents of the envelope can readily be extracted.

While the present invention is not in any way limited to a particular type of paper, it has been found that the particular configuration allows for the manufacturer to use a paper having a weight of 28 pounds and a caliper thickness on the order of 5.5 to 7.0 mils.

Suitable the invention has been illustrated in an embodiment wherein a single panel array may be used to make a variety of geometric figures. It should be appreciated that variations in the size of the panel members will permit additional shapes to be made within the scope and spirit of the invention. The foregoing description is intended to be illustrative of the invention and other variations in either the spirit or the scope of the invention may be made.

What is claimed is:

1. A sheet adapted to be folded to produce an envelope, said sheet being generally rectangular in plan view and having four lateral edges, said sheet having first and second spaced parallel fold lines dividing said sheet into a central panel portion and first and second panel portions on opposite sides of said central panel portion, said central panel portion having a flat planar edge on one end thereof, said central panel portion having a further fold line on an end opposite of said flat planar edge and extending parallel thereto to produce a tab, said first panel portion having one flat edge defining an extension of said flat planar edge and being inwardly angularly related thereto, said first panel portion having a second flat edge offset inwardly from said further fold line in said central panel portion and extending generally parallel thereto, said tab having an outer lateral flat edge spaced from said further fold line by a dimension that is less than the spacing between the second flat edge of said first panel portion and said further fold line in said central panel portion, one of said central and first panel portions having a first area of adhesive on a surface thereof adjacent said flat planar edge and a contact surface of one of said tab and said second panel portion having a second area of adhesive between said further fold line and said outer lateral flat edge of said tab, said second panel portion having opposite ends extending parallel to each other and respectively defining extensions of said flat planar edge and said further fold line of said central panel portion so that said tab can be folded along said further fold line, said sheet can be folded along said first fold line to place said first panel portion in overlapping relation with said central panel portion and subsequently along said second fold line to have said second panel portion in overlapping relation with said first panel portion while said tab is in overlapping relation with said second panel portion.

2. A sheet as defined in claim 1, in which said tab has a further edge extending generally perpendicular to said further fold line and said outer flat lateral edge of said tab adjacent to said first fold line but spaced therefrom so that said further edge is spaced from said first fold line in the folded condition of said sheet.

3. A sheet as defined in claim 2, in which said second panel portion has a free edge extending generally parallel to said first and second fold lines, said free edge being generally aligned with further edge of said tab when said sheet is in a folded condition.

4. An envelope formed from a single flat sheet having first and second opposed surfaces and first and second spaced parallel fold lines dividing said sheet into a central panel portion and first and second panel portions on respective sides of said central panel portion and folded so that a first surface portion of said first panel portion is contiguous with a first surface portion of said central panel portion and a second surface portion of said first panel portion is contiguous with a first surface portion of said second panel portion, said central panel portion having a further fold line extending perpendicular to said first and second fold lines to define a tab having one surface in contiguous engagement with said central panel portion and having a free edge spaced inwardly of said further fold line, said first panel portion having a lateral edge on an end of said envelope adjacent said further fold line, said lateral edge of said first panel portion being inwardly offset from further fold line of said central panel portion to fully expose a second surface of said tab to said second panel portion, said tab having a further edge extending perpendicular to said further fold line and said free edge of said tab and being spaced from said first fold line, said second panel portion having a free edge spaced from and extending parallel to said first fold line, said free edge of said second panel portion being generally aligned with said further edge of said tab, first connecting means interconnecting only said first and central panel portions adjacent said one end of said envelope, and second connecting means interconnecting only said tab and said second panel portion at the opposite end of said envelope.

* * * * *